US005778787A

United States Patent [19]

Stiel

[11] Patent Number: 5,778,787

[45] Date of Patent: Jul. 14, 1998

[54] CYLINDER HAVING A TWO-LEGGED SLIT FOR A ROTARY PRINTING PRESS

[75] Inventor: Jürgen Alfred Stiel, Thüngen, Germany

[73] Assignee: Koenig & Bauer-Albert Aktiengesellschaft, Wurzburg, Germany

[21] Appl. No.: 711,952

[22] Filed: Sep. 6, 1996

[30] Foreign Application Priority Data

Sep. 8, 1995 [DE] Germany ..... 195 33 178.8

[51] Int. Cl.[6] ..... B41F 1/28

[52] U.S. Cl. ..... 101/415.1

[58] Field of Search ..... 101/415.1

[56] References Cited

U.S. PATENT DOCUMENTS

| | | | |
|---|---|---|---|
| 933,946 | 9/1909 | Allen | 101/415.1 |
| 1,202,473 | 10/1916 | Birtwistle et al. | 101/415.1 |
| 2,194,560 | 3/1940 | Marchev et al. | 101/415.1 |
| 2,898,854 | 8/1959 | Crawford | 101/415.1 |
| 3,166,012 | 1/1965 | Hantscho | 101/415.1 |
| 4,466,349 | 8/1984 | Bartlett | 101/415.1 |
| 5,062,363 | 11/1991 | Reichel | 101/415.1 |
| 5,419,248 | 5/1995 | Brotzman | 101/415.1 |
| 5,651,315 | 7/1997 | Ruckmann et al. | 101/415.1 |
| 5,653,170 | 8/1997 | Puschnerat et al. | 101/415.1 |

FOREIGN PATENT DOCUMENTS

| | | |
|---|---|---|
| 32 46 039 | 6/1983 | Germany . |
| 42 38 343 | 5/1994 | Germany . |
| 295 07 523 | 8/1995 | Germany . |

*Primary Examiner*—Edgar S. Burr
*Assistant Examiner*—Leslie Grohusky
*Attorney, Agent, or Firm*—Jones, Tullar & Cooper, P.C.

[57] ABSTRACT

A cylinder for a rotary printing press is provided with a thin slit into which leading and trailing ends of a plate to be secured to the cylinder are inserted. The slit has two legs that meet at a central apex and define a generally arrow-shaped slit. A plurality of these slits can extend across the cylinder in a zig-zag shape.

13 Claims, 4 Drawing Sheets

CYLINDER HAVING A TWO-LEGGED SLIT FOR A ROTARY PRINTING PRESS

FIELD OF THE INVENTION

The present invention is directed generally to a cylinder for a rotary printing press. More particularly, the present invention is directed to a cylinder for receiving and fastening a packing of a rotary printing press. Most specifically, the present invention is directed to a cylinder having one or more narrow slits for receiving and fastening a packing of a rotary printing press. The slit or slits are each formed with two legs that are disposed to form an obtuse angle with respect to a peripheral line that is parallel to an axis of rotation of the cylinder. A plurality of these slits can extend across the width of the cylinder surface to form a somewhat zig-zag line or narrow slit which is intended to receive ends of the packings, such as plates or blankets which are to be secured to the cylinder.

DESCRIPTION OF THE PRIOR ART

In the field of rotary printing, it is frequently necessary to attach one or more flexible plates or packings to the surface of a cylinder. These flexible plates may be printing plates that are attached to printing cylinders, flexible resilient blankets that are attached to blanket cylinders or various spacers or covers that are attached to other press cylinders. Some type of plate or packing end securing assembly is included on the cylinder and is used to engage the plate end or ends and to secure the plate to the cylinder. In order to most effectively utilize the cylinder or roller to which the plate, blanket, sheet or the like is attached, it is important to restrict as little cylinder surface area as possible for the plate end securement devices. This has given rise to cylinders that have narrow slits and to plates or blankets with beveled or angled ends which are received in those slits. The plate beveled ends are held in the slits by friction or by clamping or holding assemblies situated within the cylinder.

In the German Patent Publication DE 32 46 039 A1 there is shown a cylinder of a printing press. The cylinder has a gap or slit which is open to the exterior of the cylinder and which is intended to receive the end of a printing plate or of a rubber blanket. This gap is placed at an oblique angle to a generatrix or peripheral line that is parallel to an axis of rotation of the cylinder. The ends of a rubber blanket that are inserted into this gap or slit are held in place by means of a clamping device.

A blanket cylinder, that is provided with grooves which are twisted in the axial direction of the cylinder, is shown in U.S. Pat. No. 3,166,012. Rubber blankets are fastened on this blanket cylinder by means of suitable spindles.

A limitation of these prior art devices is the fact that axial forces on the packing, such as a plate or blanket attached to the cylinder, are generated by the combined effects of the obliquely extending gap or slit and the circumferential forces acting on the packing. These axial forces may tend to cause the plate or blanket to shift on the cylinder during operation of the press. Such shifting will certainly have an adverse effect on the quality of the printed product.

It will be seen that a need exists for a cylinder clamping or fastening assembly which overcomes the limitations of the prior art. The cylinder for a rotary press in accordance with the present invention provides such a device and is a significant improvement over the prior art devices.

SUMMARY OF THE INVENTION

It is an object of the present invention to provide a cylinder for a rotary printing press.

Another object of the present invention is to provide a cylinder for receiving and clamping a packing of a rotary printing press.

A further object of the present invention is to provide a cylinder having a narrow slit for receiving and fastening a packing of a rotary printing press.

Still another object of the present invention is to provide a cylinder having one or more two legged slits each having an obtuse opening angle.

Even yet a further object of the present invention is to provide a cylinder having a plurality of two legged slits arranged in a generally zig-zag manner.

As will be discussed in detail in the description of the preferred embodiments which are presented subsequently, the cylinder in accordance with the present invention is provided with at least one narrow plate or packing end receiving slit. This slit extends across a peripheral surface of the cylinder and is directed generally radially inwardly toward the center of the cylinder. The slit has two legs which define an obtuse opening angle. The apex of this opening angle lies on a line or generatrix on the cylinder periphery which is parallel to the axis of rotation of the cylinder. Several of these slits can be situated adjacent each other across the width of the cylinder to form a somewhat W-shaped or zig-zag line. The apexes of each of these slits all lie on the same line which extends across the peripheral surface of the cylinder parallel to the cylinder's axis of rotation.

One particular advantage of the angled or two legged slits in accordance with the present invention is the reduction in channel bounce that they provide. Since the slits are not straight lines, there is a reduced area along which the cylinder is unsupported at any one time when it rolls off against a second cylinder. In the prior art devices which use straight cylinder clamping slits or channels, there is a greater area over which one cylinder is not supported as it rolls off against a second cylinder. This channel bounce, which occurs when the slit cylinder effectively falls or moves toward its cooperating cylinder, is greatly reduced by the angled or two legged slits of the present invention. The reduction in channel bounce results in a reduction in cylinder oscillation and an improvement in print quality. The improved printed product is much less apt to contain lines or other print errors.

An additional benefit of the cylinder with angled or two legged clamping slits in accordance with the present invention is the reduction in mechanical wear. Since there is much less cylinder bounce, there is a substantial reduction in wear of various press components, such as support journals, bearings and the like.

The width of the slits in the cylinder are kept as thin as possible because of the use of thin plates as printing plates and as supports for rubber blankets. The non-printing area of the plate is kept as small as possible by the use of the thin slits and this leads to more efficient web utilization as a function of cylinder diameter. In other words, the thinner the slit, the more of the cylinder surface that can be used for actual printing and thus the more effectively the web to be printed can be utilized. In addition, the use of the narrow, generally arrow or arrow-head shaped, two-legged slit or slits in accordance with the present invention result in less interference with the inking of the printing plate or reactions on the inking register.

The plate or plates are fastened on the cylinder by use of the arrow-shaped or two legged narrow slit or slits in accordance with the present invention in a manner that reduces axial forces acting on the plate or plates. This is due to the symmetrical arrangement of the slits with their ends forming a serrated edge-like array. Registration problems or deformations of the plate that have been caused by the axial acting forces in the prior art devices, are prevented by the present invention.

The cylinder for a rotary printing press in accordance with the present invention overcomes the limitations of the prior art devices. It is a substantial advance in the art.

BRIEF DESCRIPTION OF THE DRAWINGS

While the novel features of the cylinder for a rotary printing press in accordance with the present invention are set forth with particularity in the appended claims, a full and complete understanding of the invention may be had by referring to the detailed description of the preferred embodiments which are presented subsequently, and as illustrated in the accompanying drawings, in which:

DETAILED DESCRIPTION OF THE PREFERRED EMBODIMENTS

Figure 1:
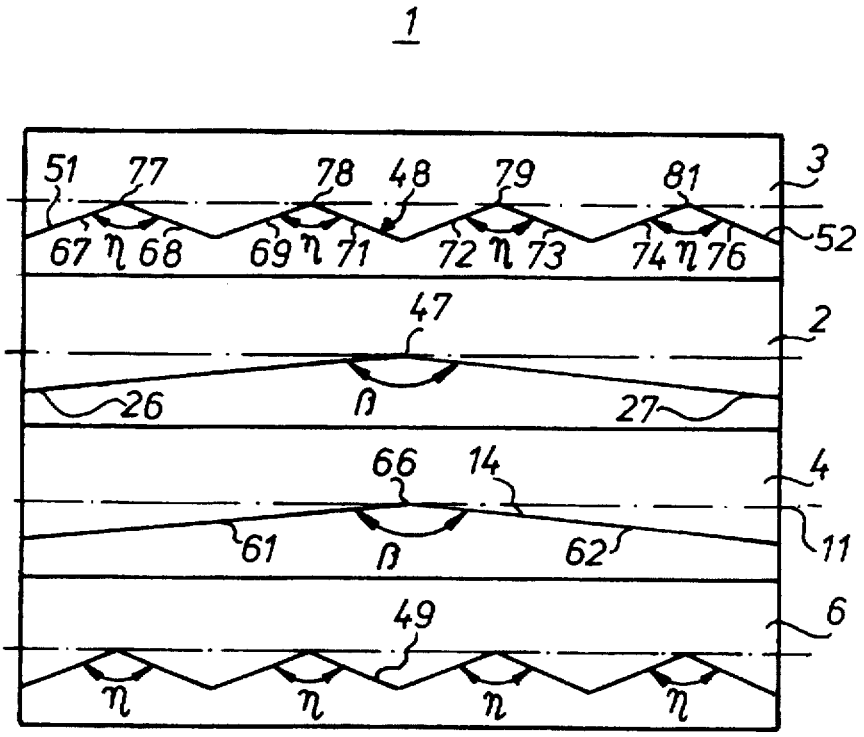
FIG. 1 is a schematic side elevation view of a printing unit having cylinders in accordance with the present invention.

Referring initially to FIG. 1, there may be seen generally at 1, and in somewhat schematic form, a printing unit of a rotary printing press. This printing unit 1 is shown having two blanket cylinders 2 and 4, and two associated plate cylinders 3 and 6. A web is printed as it passes between the two blanket cylinders 2 and 4 which have been supplied with an ink image from the plates carried by the plate cylinders 3 and 6. It will be understood that such an arrangement of cylinders to form a printing unit is generally well known in the art and is depicted here as an exemplary arrangement in which the cylinder in accordance with the present invention can be utilized. The overall configuration of the rotary printing press is generally conventional and forms no part of the present invention.

Figure 2:
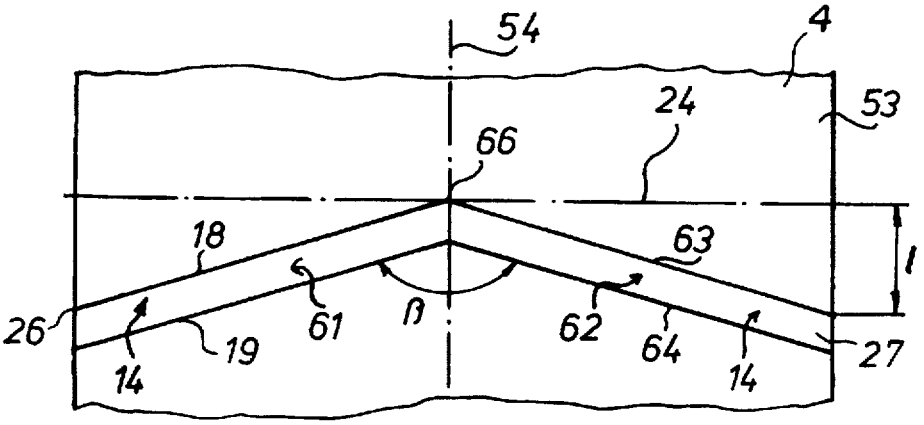
FIG. 2 is a schematic view of a portion of the surface of a cylinder of the present invention and showing a portion of a slit.
Figure 3:
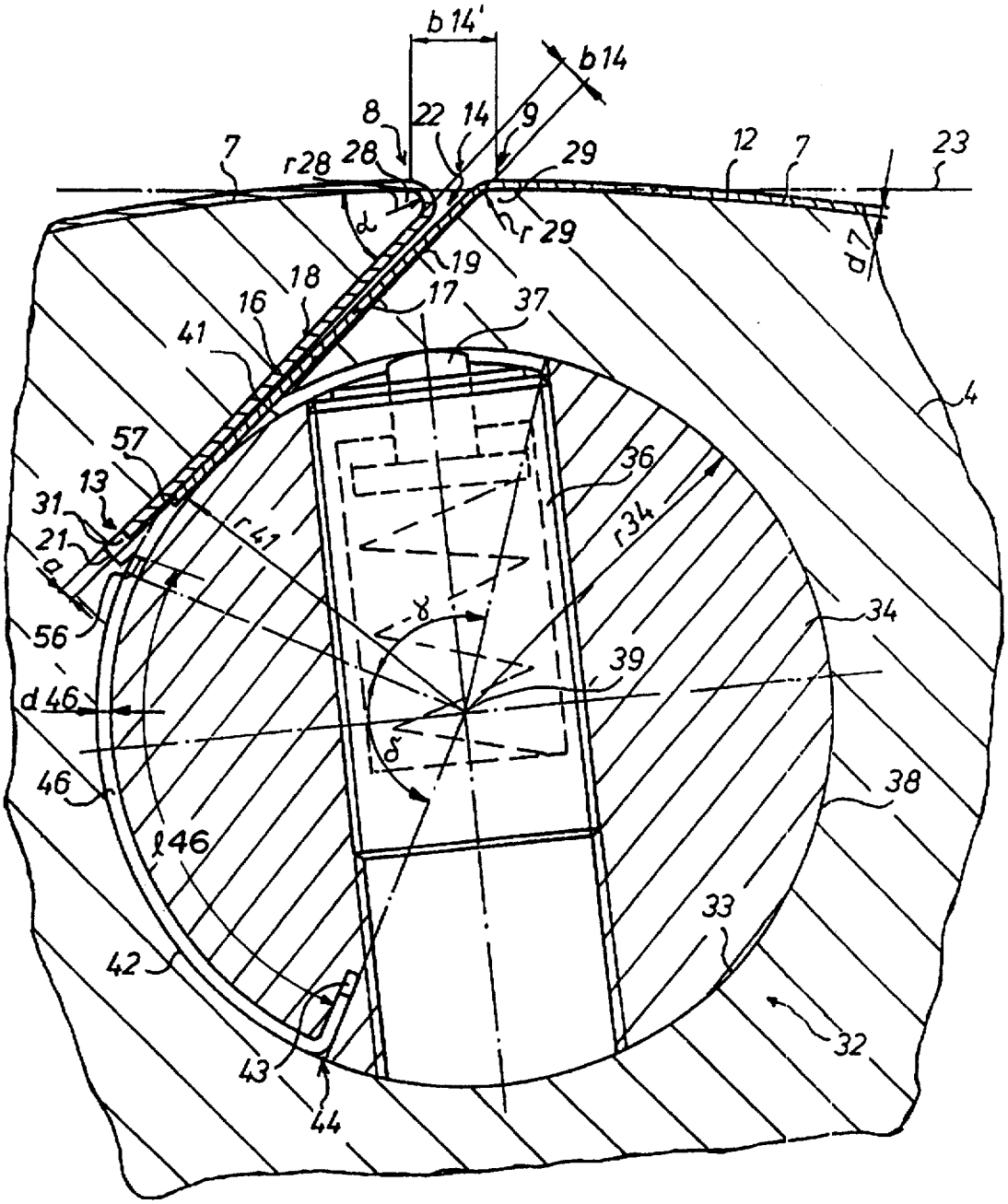
FIG. 3 is a cross-sectional view of a cylinder in accordance with the present invention and showing the cylinder in an insertion position.
Figure 4:
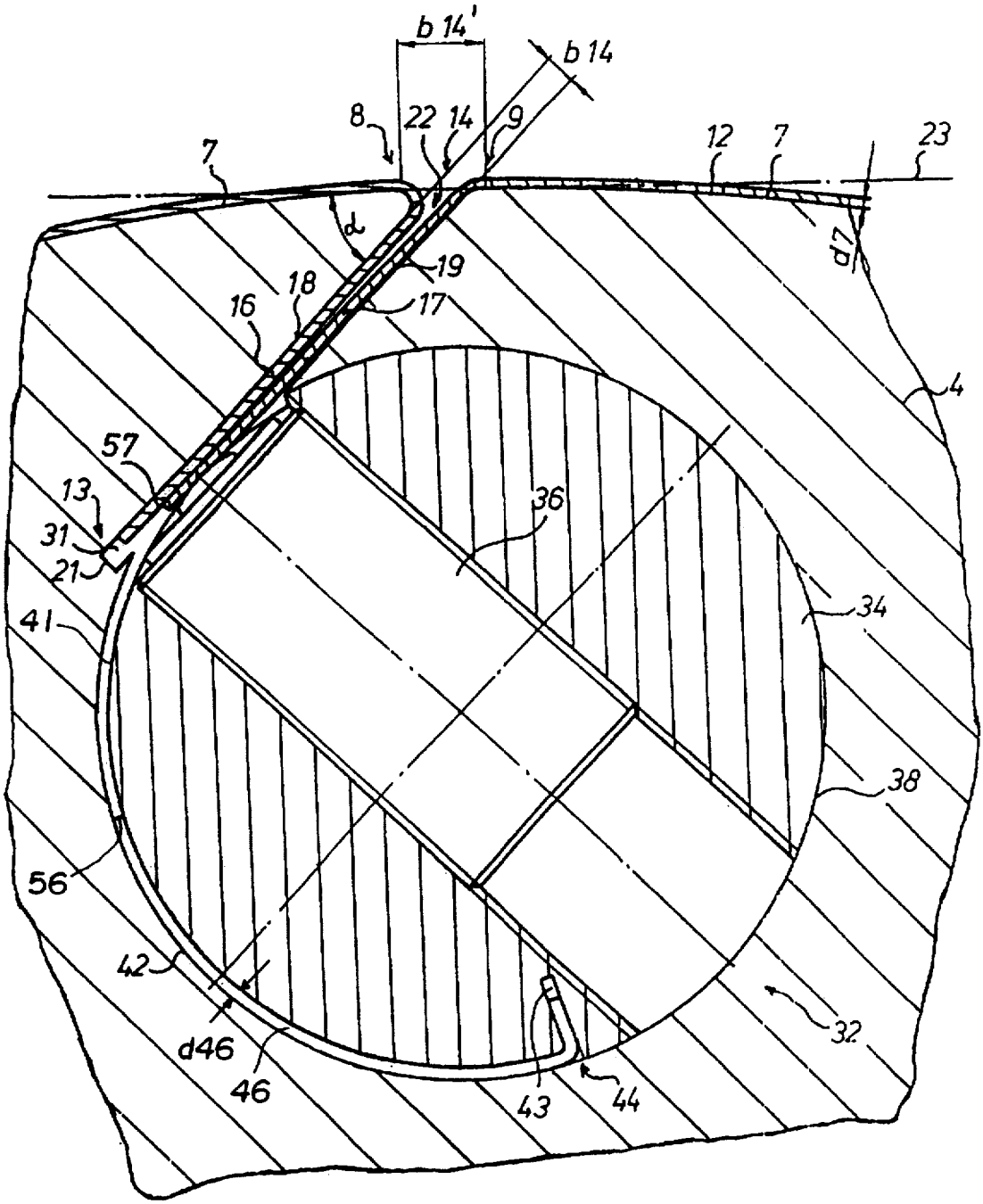
FIG. 4 is a view similar to FIG. 3 and showing the cylinder in a clamping position.
Figure 5:
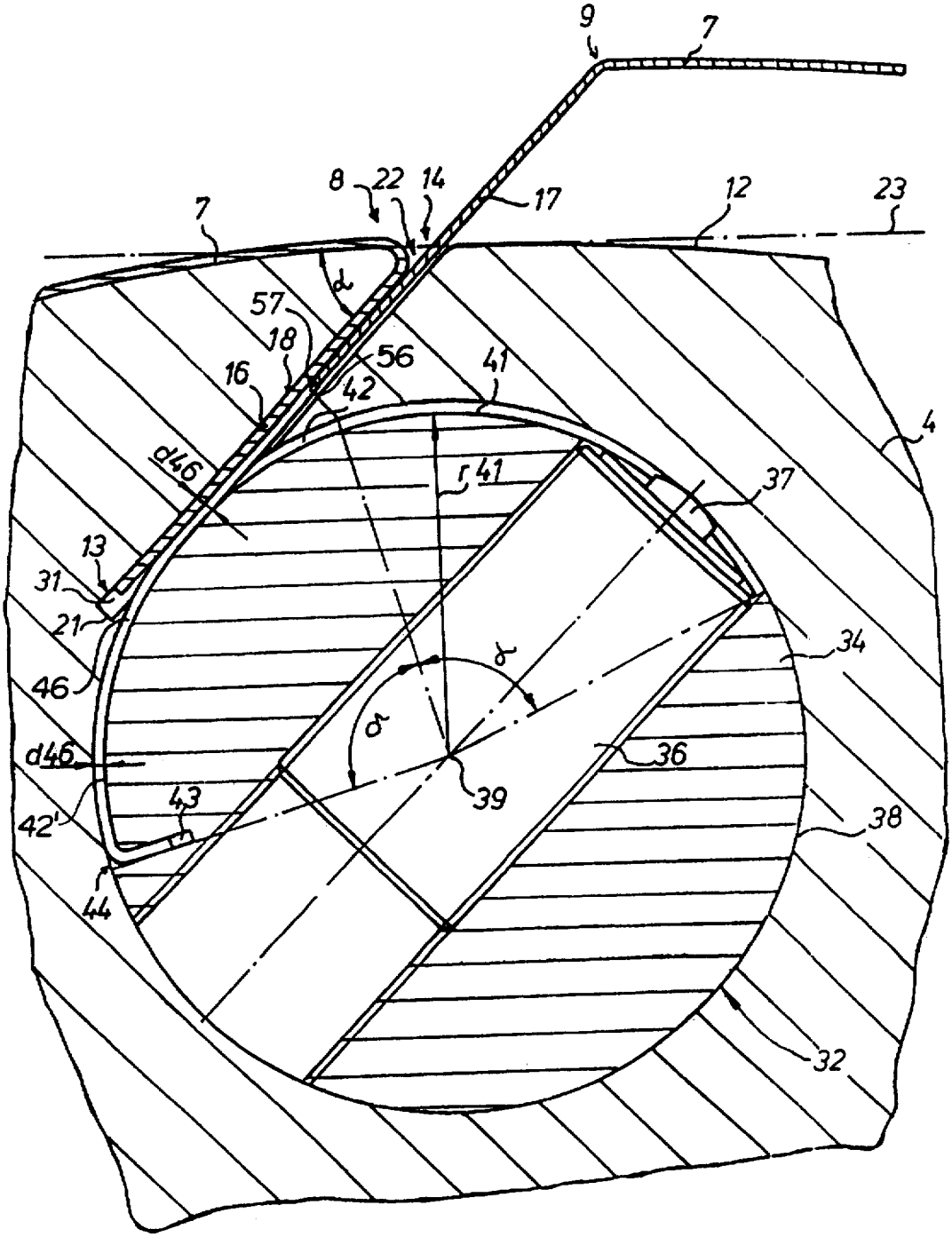
FIG. 5 is a view similar to FIGS. 3 and 4 and showing the cylinder in a plate or packing removal position.

Turning now to FIG. 2, there may be seen a portion of the plate cylinder 4 which is shown in FIG. 1. As may be seen in FIG. 2, and as is also shown in FIGS. 3–5, this cylinder 4 has at least one narrow slit 14 that is adapted to receive a cylinder covering packing in the nature of a flexible plate or plates 7 having leading and trailing beveled ends 8 and 9. The slit or slits 14, in accordance with the present invention, and as seen most clearly in FIG. 3 extend from a surface 12 of the cylinder 4 generally radially inwardly to an inner slit end 13. The plate 7, which is to be attached to the cylinder 4, has a plate thickness d7 of for example d7=0.3 mm and is preferably a printing plate or a support plate with a rubber blanket (not shown) fastened on it. A leg 16 of the leading end 8 of the plate 7 is longer, in the depicted embodiment, than a corresponding leg 17 of the trailing end 9 of the plate 7. If the plate 7 is a support plate for a rubber blanket or the like, the rubber blanket does not cover the legs 16 and 17.

As may also be seen in FIGS. 3–5, the narrow slit 14 is preferably rectangular in cross-section and is defined by first and second lateral or side faces 18 and 19, which are parallel to each other, and by a base area 21. A width b14 of the cross-section of the slit 14, which is determined by the two lateral faces 18 and 19, has a dimension of slightly more than twice the thickness d7 of the plate 7; i.e. b14=1 mm. This width is measured generally at an outer end 22 of the slit 14 which lies at the surface 12 of the cylinder 4. As may also be seen in FIGS. 3–5, the slit 14 is inclined at an angle of inclination $\alpha$ of, for example 45° with respect to a tangent 23 that contacts the surface of the cylinder 4 generally at the outer end of the slit 14.

Referring back again to FIGS. 1 and 2, and particularly to FIG. 2, it will be seen that the narrow slit 14, consists of at least two generally axially extending legs 61 and 62. In a preferred embodiment, as shown in FIG. 2, these legs 61 and 62, as defined by their respective lateral faces 18, 19, 63 and 64, meet each other on a bisecting cylinder line 54 at a kink point 66, and in the process enclose an opening angle $\beta$, in which, for example $\beta$=179.6°. This opening angle $\beta$ preferably is within a range between 170° to 190°, except for 180°, i.e. the opening angle $\beta$ preferably differs only slightly from 180°. The kink point or apex 66 of the slit 14 lies in the intersection of a generatrix 24, extending parallel with an axis of rotation 11 of the cylinder 4, and the bisecting cylinder line 54. The narrow slit 14 is thus seen as having the two legs 61 and 62 which meet each other at an apex or kink point 66 at an obtuse or opening angle $\beta$ which is not 180° but which is within relatively narrow ranges on either side of 180°. The narrow slit 14 thus is generally in the shape of an arrow head or could be referred to as being arrow-shaped.

Two ends 26 and 27 of the slit 14, i.e. the ends of the respective lateral faces 18 and 63, are each offset in the circumferential direction by a length l, for example l=2 mm, in respect to the generatrix 24 and thus to the kink point 66 of slit 14. The length l of this offset is at least as long as the width b14 of the slit 14. If a transition of the lateral faces 18, 19, 63 and 64 of the slit 14 into the surface 12 of the cylinder 4 respectively at the outer end 22 of the slit 14 has a curvature 28 or 29 with a radius r28 or r29, for example, of r28, r29=0.5 mm, the length l of the offset, for example 2.5 mm, at least corresponds to a sum of the two radii r28, r29 of the lateral faces 18 and 19 and the width b14 of the slit 14, projected on the surface 12, which corresponds to a non-supporting width b14', for example 2.5 mm, of the slit 14. Thus the slit 14 is angled at least by a length l corresponding to the non-supporting width b14' of the slit 14. In the first preferred embodiment, as seen in FIGS. 1 and 2, the slit 14 is arrow-shaped and is disposed axially symmetrical in respect to the bisecting cylinder line 54. This first preferred embodiment is particularly suited for use in the retention of a support plate 7 for a rubber blanket.

In a second preferred embodiment, as may be seen in FIG. 1, a plate cylinder 3 or 6 for use in receiving four plates placed next to each other, is represented by way of example. In this second preferred embodiment, a slit 48 consists of eight legs 67, 68; 69, 71; 72, 73; and 74, 76, which form opening angles $\eta$ at four kink points 77, 78, 79 and 81. Thus this slit 48 has a serrated course with four teeth. In this case, each one of the four associated plates which will be attached to each of the two plate cylinders 3 and 6 is provided with a leading and trailing end that is beveled in an arrow shape. It will be understood that the provision of this slit 48 with four cusps or kink points 77, 78, 79 and 81 along its serrated course is exemplary and that the slit 48 could be provided with either more or fewer kink points 77, 78, 79 and 81.

In the two preferred embodiments depicted in FIGS. 1 and 2, the slit 14 and 48 is embodied to be continuous in the axial direction, i.e. the legs 61, 62, and 67, 68; 69, 71; 72, 73; and 74, 76 extend directly into each other. It is also possible in the present invention to embody the slits 14 or 48 not to be continuous in the area of the kink point 66. The remaining piece of the surface 12, or a special insert piece, together with a plate 7 fitted thereon, is then used for setting the lateral register and thus acting as a lateral register stop. In this case the plate 7 has a recess matched to this at its beveled ends 8 and 9.

Turning now to FIGS. 3–5, an axially extending bore 32 is formed in the cylinder 4 extending obliquely to slit 14 and parallel with the axis parallel generatrix 24. An inner portion of the inner end 13 of the slit 14, located at the interior 31 of the cylinder 4 is in contact with the bore 32. The slit 14 is tangent with respect to the bore 32 so the bore 32 is in connection with the slit 14. In the subject invention, there is a virtual continuation of a surface area 33 of the bore 32 at a distance "a" in respect to a lateral face 18 of the slit 14 facing away from the bore 32. This distance "a" is slightly greater than the thickness d7 of the plate 7. For example, a=0.4 mm.

A pivot lever 34 which, in the subject invention, is configured as a spindle or packing fastening shaft 34 having a radius r34 of, for example, r34=15 mm, is seated in the bore 32. The pivot lever or spindle 34 is centered in the cylinder bore 32 and is rotatable about its longitudinal axis 39 with respect to the cylinder 4 in the bore 32. A plurality of radially outwardly acting pressure elements, generally at 36, are axially spaced along the length of the spindle 34. These pressure elements 36 are secured in the spindle 34 in such a way that pressure cams 37 which are part of the pressure elements 36, can resiliently act or extend radially outwardly beyond a circumferential surface 38 of the spindle 34. Each of these pressure cams 37 may be provided with a ball or generally rounded end cap at its radially outer end. Other end shapes, such as cylinder segments, are also possible. Each pressure cam 37 forms a contact zone, which may be, for example, linear with the surface of the plate end which it contacts, as seen in FIG. 4.

As may be seen in each of FIGS. 3, 4 and 5, the circumferential surface 38 of the spindle 34 is discontinuous about its circumferential length. In the area of radially outwardly acting pressure elements 36, the surface 38 of the spindle 34 has a surface area portion 41 of a continuous reduced radius r41 in which r41=14.5 mm. This reduced radius surface area portion 41 has a arcuate length $\gamma$ of generally 80° with respect to a longitudinal axis 39 of the spindle 34. This is followed, as may be seen in the drawings, by a second, discontinuous reduced diameter portion 42 extending over an angle $\delta$ of generally 90° in which this second, discontinuous reduced surface area 42, viewed in the axial direction of the spindle 34, is only partially provided in the form of a plurality of generally U-shaped grooves 42' which each extend in the circumferential direction of the spindle 34. Thus the reduced diameter portion of the spindle 34 has a first continuously reduced diameter portion 41 and a second discontinuous reduced diameter portion 42. This second, discontinuous reduced diameter portion 42 or plurality of U-shaped grooves 42' terminates in an axially extending spindle surface channel or slot 43 that is cut into spindle 34 and which extends radially inwardly into the spindle 34 from its surface 38.

A resilient ejector 46 is situated in each of the U-shaped grooves 42' formed in the spindle 34. A first end 44 of each resilient ejector 46 is positioned in the spindle channel 43. These resilient ejectors 46 are made of a flexible, elastic but pressure resistent material and in the preferred embodiment are leaf springs made of spring steel. Each of these ejectors has a length 146 of, for example, 146=25 mm. Each ejector is sized to be receivable in its cooperating U-shaped groove 42' on the discontinuous reduced diameter portion 42 of the spindle 34. The length 146 of each spindle is sufficient to bring a free second end 56 of each ejector 46 into the first, continuous reduced diameter portion 41 of the spindle 34. Each ejector 46 has a thickness d46 wherein d46=0.5 mm, for example.

Instead of using only one axis parallel extending shaft or spindle 34, it would also be possible to arrange several spindles or shafts, corresponding to the number of legs 61 and 62 parallel with the extent of the slit 14. These spindles 34 could then be connected by means of torsion-proof couplings which would compensate between the angular offsets of the shafts or spindles.

These cylinders 2, 3, 4 and 6, which are provided with the zig-zag-shaped slits 14, 47, 48 and 49, are preferably synchronized with each other in such a way, that ends 26 and 51 or 27 and 52 of two slits 14 and 49 or 47 and 48 of two cooperating cylinders 4 and 2 or 2 and 3 or 4 and 6 are offset on a involute surface 53 by at least the length l of the inclination of a slit 14, 47, 48 or 49. In this way, axially symmetrical contact zones result in respect to the bisecting cylinder line 54.

The operation of the cylinder for a rotary printing press, in accordance with the present invention, in use in the fastening and removal of a plate 7, will now be discussed in detail and by referring to cylinder 4. With the cylinder 4 in a plate end insertion position, as depicted in FIG. 3, the spindle 34 has been rotated so that the first, continuous reduced diameter portion 41 is generally adjacent the radially inner end of the cylinder slit 14. This situates the resilient ejectors 46 beneath or radially inwardly of the slit 14 and the pressure elements 36 out of contact with the cylinder slit 14. In this plate end insertion position, the beveled plate ends 8 and 9 can be inserted into the slit 14 with the continuous reduced area 41 of the spindle 34 acting as a guide. As soon as the beveled plate ends 8 and 9 have been fully inserted into the cylinder slit 14 and the flexible plate 7 has been pressed against the surface 12 of the cylinder 4, the spindle 34 will be rotated in a counterclockwise direction into the clamping position which is depicted in FIG. 4. This counterclockwise rotation of the spindle 34 will locate the pressure elements 36 so that they are generally perpendicular with the legs 16 and 17 of the plate ends 8 and 9 and so that their pressure cams 37 will bear against the legs 16 and 17 of the beveled plate ends 8 and 9. These pressure cams 37 may be pressed against the plate end legs 16 and 17 by the force of suitable springs which are carried within the pressure elements, as is depicted in a somewhat schematic fashion in the drawings. This cooperation of the pressure elements 36 carried by the spindle 34, the pressure cams 37 which are part of the pressure elements, and the spring forces and the spring travel which urge the pressure cams 37 into clamping contact with the ends 8 and 9 of the plate 7 is effective to securely clamp the flexible plate 7 onto the surface of the cylinder 4. The ends 8 and 9 of the plate 7 are clamped in the narrow slit 14 of the cylinder 4 by the action of the pressure cams 37 which stretch and pull the plate ends 8 and 9 radially inwardly into the cylinder slit 14. Once the spindle 34 has been turned to the clamped position depicted in FIG. 4, it can be stopped and retained in that position.

Referring now primarily to FIG. 5, when it is desired to release the plate ends 8 and 9 from the narrow slit 14, the spindle 34 will be rotated in a clockwise direction into a plate end ejection position. As the spindle 34 is rotated in this clockwise direction, the pressure elements 36 will move out of contact with the legs 16 and 17 of the plate ends 8 and 9 to thus release the plate ends. This rotation of the spindle 34 brings the pressure elements 36 into the portion of the cylinder bore 32 in which the pressure cams 37 engage the surface 33 of the cylinder bore 32. As the spindle 34 is continued to be rotated in the clockwise direction, the free ends 56 of the resilient ejectors 46 will now reach the area of the trailing end 9 of the flexible plate 7. As is shown in FIG. 5 a first face of each ejector free end 56 will abut a front face 57 of the leg 17 of the trailing plate end 9 and will exert a radially outwardly directed force against it. As the spindle 34 is continued to be rotated in a clockwise direction, the resilient ejectors 46 spring out of their U-shaped grooves 42' and extend radially upwardly into the narrow cylinder slit 14. This positions the free ends 56 of the ejectors generally tangentially with respect to the spindle 34 with the ejector free ends 56 extending toward the radial outer end 22 of the slit 14. The spindle 34 is rotated in its clockwise direction until the free end 56 of each of the resilient ejectors 46 is situated just beneath, but closely adjacent to the surface 12 of the cylinder 4. This has the effect of completely removing the trailing end 9 of the flexible plate 7 from the narrow cylinder slit 14. The inherent resiliency of the flexible plate 7 and its intrinsic tension will act to cause the plate trailing end 9 to spring out of the cylinder slit 14 once it has been moved to the ejection portion depicted generally in FIG. 5. It would also be possible to utilize pre-stressed leaf springs in place of the pressure elements 36 and pressure cams 37. Such pre-stressed leaf springs would be arranged in the circumferential direction of the clamping lever or spindle 34 and would extend radially outwardly beyond the surface area 38 of the spindle 34.

While preferred embodiments of a cylinder for a rotary printing press in accordance with the present invention have been set forth fully and completely hereinabove, it will be apparent to one of skill in the art that a number of changes in, for example, the type of printing press used, the overall sizes of the cylinders, the type of plate being attached to the cylinder and the like could be made without departing from the true spirit and scope of the present invention which is accordingly to be limited only by the following claims.

What is claimed is:

1. A cylinder for a rotary printing press comprising:

a cylinder peripheral surface; and at least a first cylinder packing receiving two legged slit in said cylinder and having an outer portion on said cylinder peripheral surface, said two legged slit consisting of first and second legs, said first and second legs being disposed enclosing an apex of an opening angle of other than 180°, said apex of said opening angle lying on a line on said cylinder peripheral surface, said line being parallel to an axis of rotation of said cylinder.

2. The cylinder of claim 1 wherein said two legged slit is symmetrical with respect to a cylinder bisecting line extending generally perpendicular to a cylinder axis of rotation.

3. The cylinder of claim 1 wherein said first and second legs engage each other at said apex of said opening angle.

4. The cylinder of claim 1 further including a space forming a lateral register stop in said apex.

5. The cylinder of claim 1 wherein said two legged slit has a generally rectangular cross-section defined by first and second lateral faces, a base area and said outer portion, a width of said two legged slit being slightly greater than twice a thickness of a plate receivable in said slit.

6. The cylinder of claim 1 wherein each of said first and second legs has an end and further wherein said ends are offset in a circumferential direction on said cylinder from said apex by a first length.

7. The cylinder of claim 6 wherein said first length is at least equal to a width of said slit at said cylinder peripheral surface.

8. The cylinder of claim 1 further including a bore in said cylinder and a packing fastening shaft in said bore.

9. The cylinder of claim 8 wherein said packing fastening shaft extends parallel with an axis of rotation of said cylinder.

10. The cylinder of claim 8 further including a plurality of radially acting resilient pressure cams disposed adjacent each other along said packing fastening shaft, each of said pressure cams having an end face engageable with a plate end inserted into said slit.

11. A cylinder for a rotary printing press comprising:

a cylinder peripheral surface; and a cylinder packing receiving slit in said cylinder and having an outer portion on said cylinder peripheral surface, said slit having at least first and second legs, said legs being disposed enclosing an apex of an opening angle of other than 180°, said slit extending across said cylinder peripheral surface in a zig-zag manner.

12. The cylinder in accordance with claim 11 wherein said zig-zag slit has a plurality of apexes and further wherein said apexes are disposed on a generatrix extending parallel with an axis of rotation of said cylinder.

13. The cylinder of claim 11 wherein said zig-zag slit is symmetrical with respect to a cylinder bisecting line extending generally perpendicular to a cylinder axis of rotation.

* * * * *